US009033559B2

(12) United States Patent
Ting et al.

(10) Patent No.: US 9,033,559 B2
(45) Date of Patent: May 19, 2015

(54) ASSEMBLING HEAT DISSIPATING LIGHTING DEVICE

(71) Applicant: POLAR-LIGHTS OPTO CO., LTD., Xinbei (TW)

(72) Inventors: Hsien-Chih Ting, Xinbei (TW); Cheng-Tai Chou, Xinbei (TW); Chun-Jiun Chang, Xinbei (TW)

(73) Assignee: Polar-Lights Opto Co., Ltd., Xinbei (TW)

( * ) Notice: Subject to any disclaimer, the term of this patent is extended or adjusted under 35 U.S.C. 154(b) by 124 days.

(21) Appl. No.: 13/946,593

(22) Filed: Jul. 19, 2013

(65) Prior Publication Data

US 2014/0369053 A1 Dec. 18, 2014

(30) Foreign Application Priority Data

Jun. 13, 2013 (TW) ..... 102211038 U

(51) Int. Cl.
*F21V 29/00* (2006.01)

(52) U.S. Cl.
CPC ..... *F21V 29/22* (2013.01)

(58) Field of Classification Search
CPC ..... F21V 29/004
USPC ..... 362/373, 294, 364, 365
See application file for complete search history.

(56) References Cited

U.S. PATENT DOCUMENTS

| | | | | |
|---|---|---|---|---|
| 6,632,006 | B1 * | 10/2003 | Rippel et al. | 362/366 |
| 8,550,669 | B2 * | 10/2013 | Macwan et al. | 362/366 |
| 2014/0254177 | A1 * | 9/2014 | Danesh | 362/363 |

* cited by examiner

*Primary Examiner* — Evan Dzierzynski

(57) ABSTRACT

An assembling heat dissipating lighting device comprises a lamp socket means and a heat dissipating lighting means. The lamp socket means includes an installing space and an installing hole communicated with the installing space. A periphery of the installing hole is formed with an inserting portion and an engaging portion. The heat dissipating lighting means includes a LED lighting member and a heat dissipating member thermally connected with the LED lighting member, and an outer ring surface of the LED lighting member has an engaging element and a fastening portion. The heat dissipating lighting means is fixed to the lamp socket means by way of engaging the engaging element into the installing space and correspondingly engaging the fastening portion with the engaging portion by way of rotating the heat dissipating lighting means. Thus, the convenience of disassembly and fixation of the assembling heat dissipating lighting device is increased.

10 Claims, 7 Drawing Sheets

ASSEMBLING HEAT DISSIPATING LIGHTING DEVICE

CROSS-REFERENCE TO RELATED APPLICATION

This application claims priority to Taiwanese Patent Application No. 102211038, filed Jun. 13, 2013, which is hereby incorporated by reference.

FIELD OF THE INVENTION

The present invention relates to a lighting device, and more particularly to an assembling heat dissipating lighting device.

BACKGROUND OF THE INVENTION

Since LED has various advantages such as lightweight, low power consumption, environmental protection, high speed of light response and long lifetime, light lamps having LED as light source have been hailed as the light of twenty-first century to gradually replace with incandescent lamps, halogen lamps, and fluorescent lamps which have the disadvantages of high electricity consumption. The LEDs as light source are enormously used in lighting apparatus.

The conventional LED lighting apparatus includes a LED lamp means and a lamp socket means. The LED lamp means typically includes a plurality of LED chips, a lampshade covering on the LED chips, a heat dissipating fin, and a screw member. Due to thermal energy produced by the LED chips needs to be dissipated by the heat dissipating fin, it is found that the heat dissipating fin is disposed between the lampshade and the screw member. The LED lamp means is installed in the lamp socket means by correspondingly screwing the screw member to screw the screw member to a screw portion of the lamp socket means by way of repeatedly rotating the LED lamp means. However, a user must exert himself/herself to repeatedly rotate the LED lamp means for installing the LED lamp means to the lamp socket means to thus cause much inconvenience.

SUMMARY OF THE INVENTION

Therefore, the present invention has been made in view of the above circumstances and provides an assembling heat dissipating lighting device so that the LED lamp means can be quickly fixed to the lamp socket means.

An assembling heat dissipating lighting device according to one embodiment of the present invention comprises: a lamp socket means and a heat dissipating lighting means. The lamp socket means includes including an installing space and an installing hole communicated with the installing space, a periphery of the installing hole being formed with an inserting portion and an engaging portion. The heat dissipating lighting means including a LED lighting member and a heat dissipating member thermally connected with the LED lighting member, the LED lighting member having a light emitting surface, and an outer ring surface of the LED lighting member having an engaging element corresponding to the inserting portion, and a fastening portion being formed between the engaging element and the light emitting surface. The heat dissipating lighting means is fixed to the lamp socket means by disposing the heat dissipating member through the inserting portion into the installing space of the lamp socket means by way of engaging the engaging element into the installing space and correspondingly engaging the fastening portion with the engaging portion by way of rotating the heat dissipating lighting means.

According to an embodiment of the present invention, the outer ring surface of the heat dissipating lighting means is further provided with a convex ring member, and the engaging portion is formed between the convex ring member and the engaging element.

According to an embodiment of the present invention, the engaging element, at an end adjacent to the fastening portion, has a fringe selecting from one of a group of fringe consisting of a sector engaging fringe, a rectangle engaging fringe, a serrated engaging fringe, a concave arcuate engaging fringe, and a convex engaging fringe.

According to an embodiment of the present invention, the lamp socket means has a heat dissipating through hole being located in a side opposite to the installing hole and being communicated with the installing space, and the location of the heat dissipating member is facing to the heat dissipating through hole.

According to an embodiment of the present invention, the lamp socket means is provided with a slide fastening member on a side plate that is adjacent to and substantially perpendicular to a plate provided with the installing hole, and the slide fastening member is provided to fasten with a slide fastening holder of another lamp socket means by a movement of sliding.

According to an embodiment of the present invention, one side plate of the lamp socket means which is adjacent to and substantially perpendicular to a plate provided with the installing hole is provided with a slide fastening member, and another side plate of the lamp socket means is provided with a slide fastening holder.

According to an embodiment of the present invention, the slide fastening member is formed as a pair of L-shaped sliding rails respectively formed bending outwardly, and the slide fastening holder is formed as a pair of L-shaped slip respectively formed bending inwardly.

According to an embodiment of the present invention, the lamp socket means has an opening portion, a fitting element convexly extends from an internal surface of the opening portion for jointing the opening portion of another lamp socket means.

According to an embodiment of the present invention, the LED lighting member includes a circular tank and a LED lighting element, the engaging element and the fastening portion are located on the outer ring surface of the circular tank, the LED lighting element has the light emitting surface, a center of a circular area of the circular tank has a light hole, and the light emitting surface is corresponding to the light hole.

According to an embodiment of the present invention, the inserting portion is an inserting groove, and the engaging element is an engaging bump.

By means of technical means applied by the present invention, the heat dissipating lighting means is fixed to the lamp socket means by inserting the engaging element through the inserting portion to the installing space of the lamp socket means and then correspondingly engaging the fastening portion to the engaging portion by way of slight rotating the heat dissipating lighting means. Additionally, the heat dissipation member is moved along with engaging element to hide in the installing space of the lamp socket means, and thus the lamp socket means not only help the enhancement of the heat dissipation for the heat dissipating lighting means, but also improves the esthetic feeling of the assembling heat dissipating lighting device in a whole. Further, since the engaging element and the inserting portion in the present invention are used as the substitution for the screw member and the screw portion in the conventional LED lighting apparatus, it solves the problems happening for impropriety of dimensional tolerances between the screw member and the screw portion and the rust oxidation caused in the screw member and the screw portion as well.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
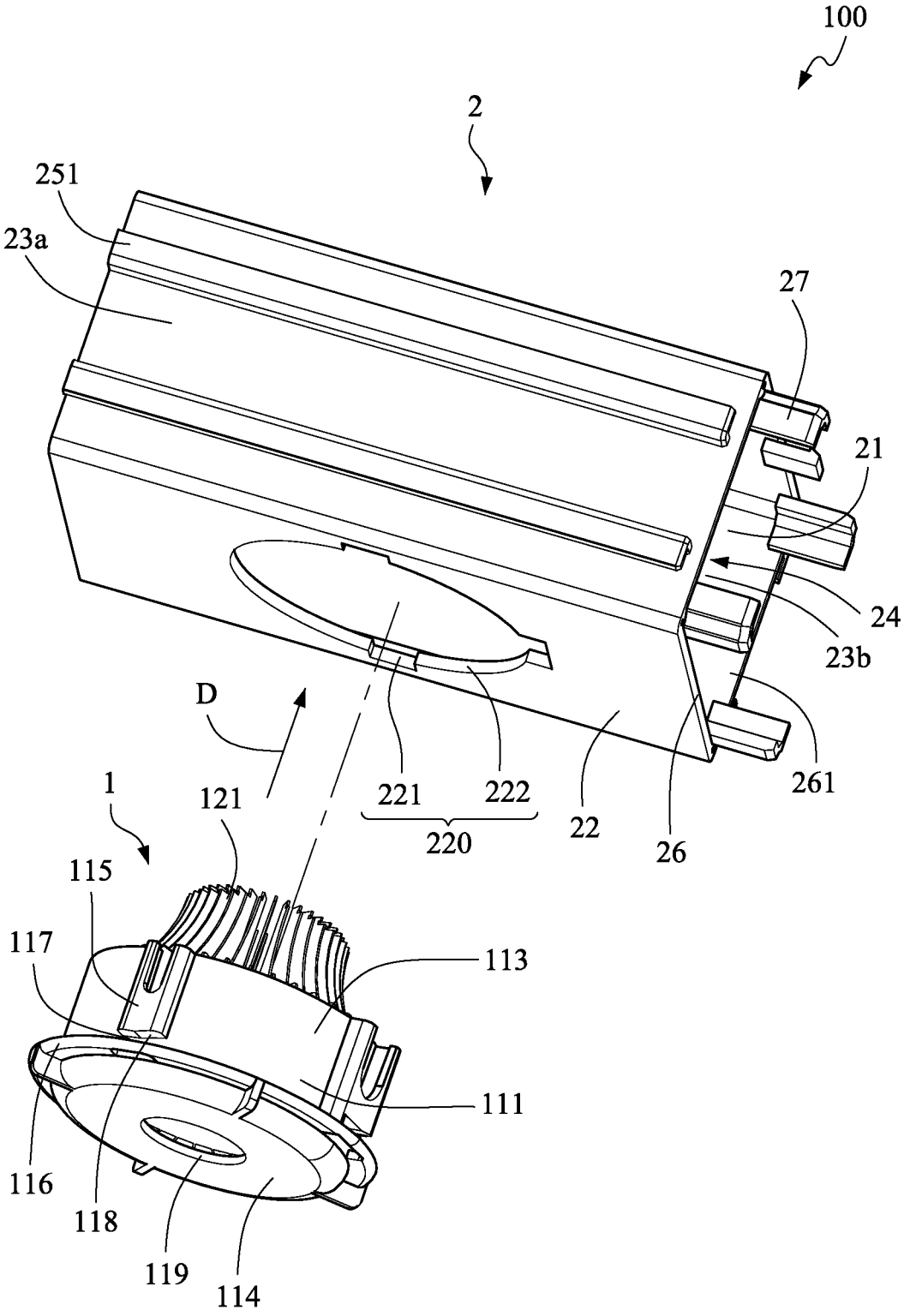
FIG. 1 is a stereogram illustrating an assembling heat dissipating lighting device of an embodiment according to the present invention.
Figure 2:
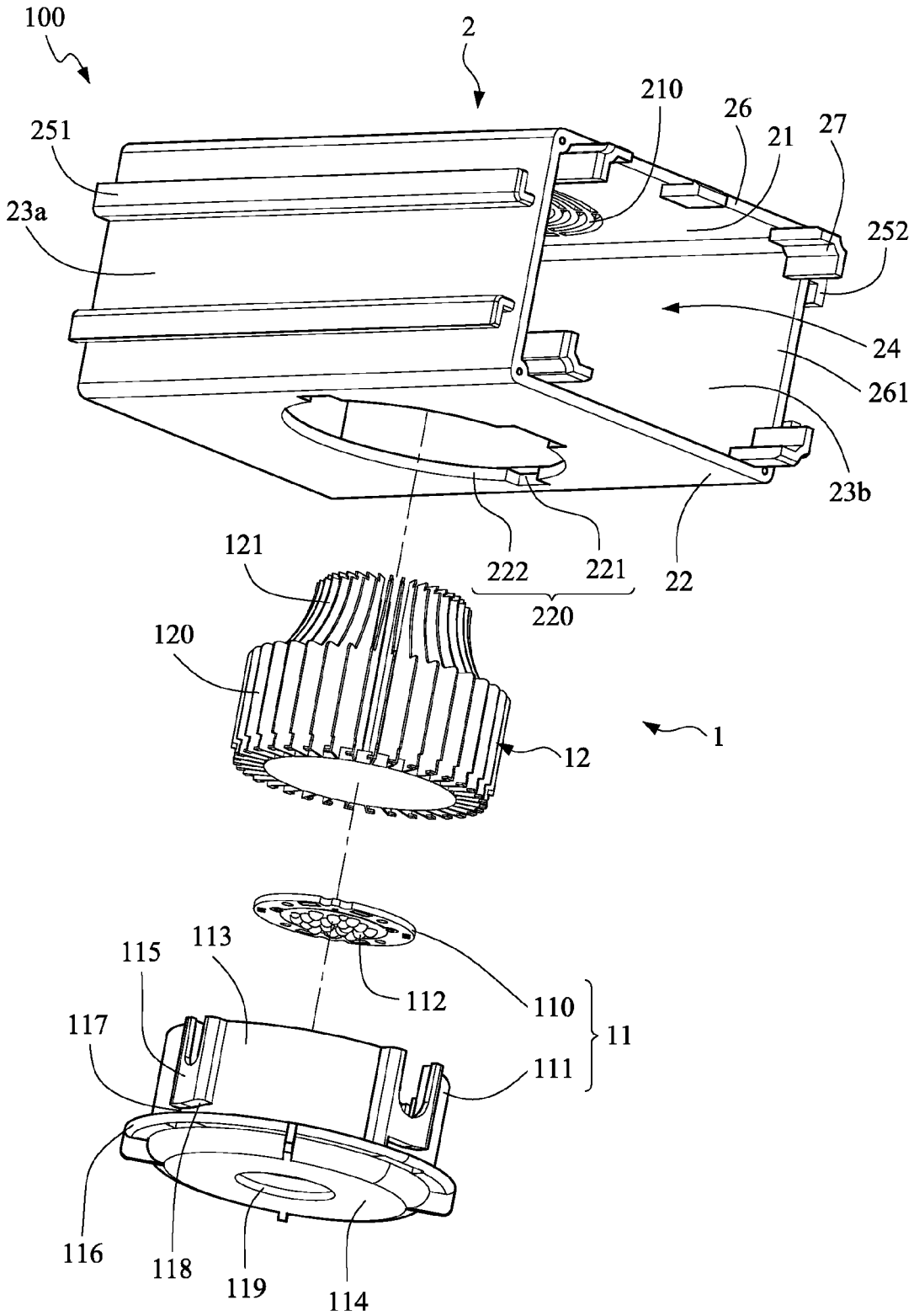
FIG. 2 is an explosion diagram illustrating the assembling heat dissipating lighting device of the embodiment according to the present invention.
Figure 3A:
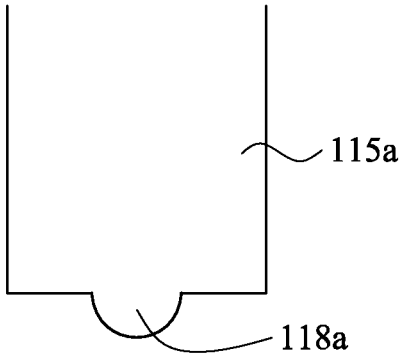
FIG. 3*a* is a schematic diagram illustrating an engaging element of an embodiment according to the present invention.
Figure 3B:
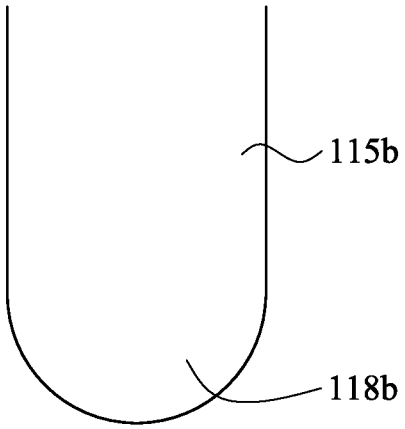
FIG. 3*b* is a schematic diagram illustrating an engaging element of an embodiment according to the present invention.
Figure 3C:
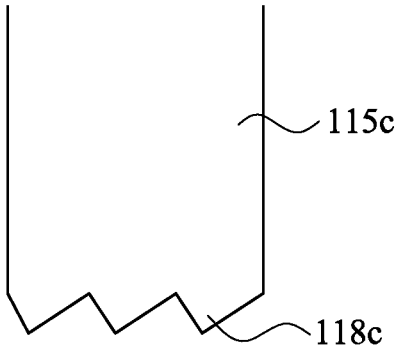
FIG. 3*c* is a schematic diagram illustrating an engaging element of an embodiment according to the present invention.
Figure 3D:
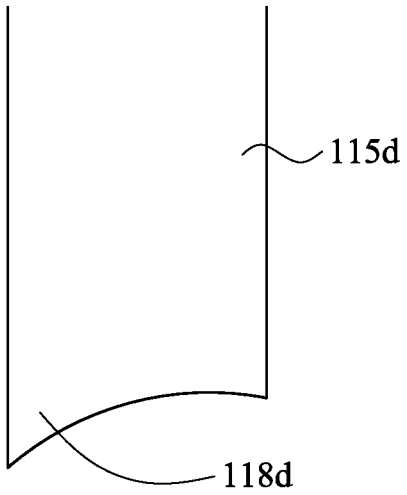
FIG. 3*d* is a schematic diagram illustrating an engaging element of an embodiment according to the present invention.
Figure 3E:
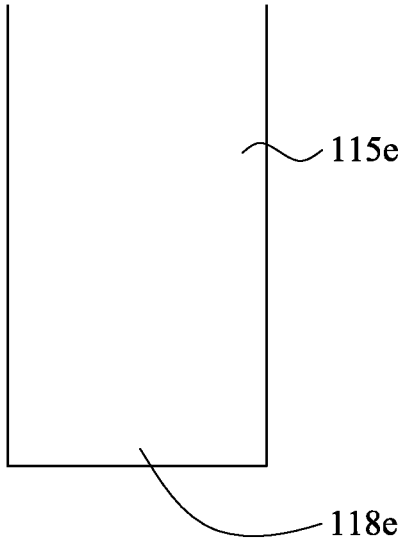
FIG. 3*e* is a schematic diagram illustrating an engaging element of an embodiment according to the present invention.

As illustrated in FIG. 1 and FIG. 2, an assembling heat dissipating lighting device of an embodiment according to the present invention includes a heat dissipating lighting means 1 and a lamp socket means 2.

The heat dissipating lighting means 1 includes a LED lighting member 11 and a heat dissipating member 12.

The LED lighting member 11 includes a LED lighting element 110 and a circular tank 111. The LED lighting element 110 is a COB (chip on board) type LED and has a light emitting surface 112. However, the present invention is not limited to this. In another embodiment, the LED lighting element 110 can be replaced with a SMD (surface mount devices) type LED. The circular tank 111 has an outer ring surface 113 and a circular area 114. The outer ring surface 113 has an engaging element 115, a convex ring member 116, and a fastening portion 117. The engaging element 115 is a plurality of engaging bumps, providing a convex engaging fringe 118 on one end toward the same direction of the light emitting surface 112 of the LED lighting element 110. The convex ring member 116 is an annular bump which surrounds the outer ring surface 113 of the circular tank 111. The fastening portion 117 is formed between the engaging element 115 and the convex ring member 116. A center of the circular area 114 has a light hole 119, the location of the light hole is corresponded to the light emitting surface 112.

The heat dissipating member 12 is a heat dissipating fin and is thermally connected with the LED lighting element 110. The heat dissipating member 12 includes a heat dissipating portion 120 and a heat dissipating extension portion 121. The heat dissipating portion 120 is covered by the circular tank 111. The heat dissipating extension portion 121 extending from the heat dissipating portion 120 is extended over the circular tank 111. However, the present invention is not limited to this. In another embodiment, the heat dissipating member 12 can be replaced with other elements such as a heat dissipating fan, a heat pipe, a heat spreader, a combination of the heat pipe and the heat spreader, or their other combination.

The lamp socket means 2 is a rectangular tube and includes a top plate 21, a bottom plate 22, and two side plates 23*a*, 23*b*. The top plate 21, the bottom plate 22, and the two side plates 23*a*, 23*b* are jointly surrounding an installing space 24. The bottom plate 22 has an installing hole 220, which is communicated with the installing space 24. A periphery of the installing hole 220 is formed with an inserting portion 221 and an engaging portion 222. The inserting portion 221 is a plurality of inserting grooves and is compatible with the engaging element 115. The engaging portion 222 is adjacent to the inserting portion 221 and is compatible with the fastening portion 117. The side plates 23*a*, 23*b* are respectively connected between the top plate 21 and the bottom plate 22 and are substantially perpendicular to the top plate 21 and the bottom plate 22.

In the assembly process for fixing the heat dissipating lighting means 1 to the lamp socket means 2, it disposes the heat dissipating member 12 in the installing space 24 of the lamp socket means 2 by inserting and engaging the engaging element 115 of the heat dissipating lighting means 1 through the inserting portion of the lamp socket means 2 along an installation direction D into the installing space 24. The installation direction D is perpendicular to the light emitting surface 112, and the heat dissipating extension portion 121 is disposed in the installing space 24 along the installation direction D. Furthermore, the heat dissipating lighting means 1 is fixed to the lamp socket means 2 by gradually engaging the engaging portion 222 along the convex engaging fringe 118 with the fastening portion 117 provided between the engaging element 115 and the convex ring member 116 by way of a slight rotation of the heat dissipating lighting means 1. However, the present invention is not limited to this. As shown in FIG. 3*a* to FIG. 3*e*, in other embodiments, the convex engaging fringe 118 can be replaced with a sector engaging fringe 118*a*, 118*b*, a serrated engaging fringe 118*c*, a concave arcuate engaging fringe 118*d*, a rectangle engaging fringe 118*e*, or an engaging fringe with other configuration. Moreover, the engaging portion 222 can further provide with one or more bumps, and the shape of the bumps can be a sector, a serrated, or other configuration. While the heat dissipating lighting means 1 is being screwed into the lamp socket means 2, the fastening portion 117 is positioned in the engaging portion 222 by fastening the bumps onto the fastening portion 117. In additional, the engaging element 115 and the fastening portion 117 can be respectively replaced with an engaging groove, and the engaging element 115 is communicated with the fastening portion 117. The inserting portion 221 can be replaced with an inserting bump. The heat dissipating lighting means 1 is fixed on the lamp socket means 2 by engaging the inserting portion 221 with the fastening portion 117 through the engaging element 115.

Furthermore, in the present embodiment, the top plate 21 further has a heat dissipating through hole 210, located in a side opposite to the installing hole and is communicated with the installing space 24. The location of the heat dissipating through hole 210 is facing the heat dissipating extension portion 121 of the heat dissipating member 12. Thus, the thermal energy accumulated in the heat dissipating extension portion 121 can be dissipated from the heat dissipating through hole 210.

Figure 4:
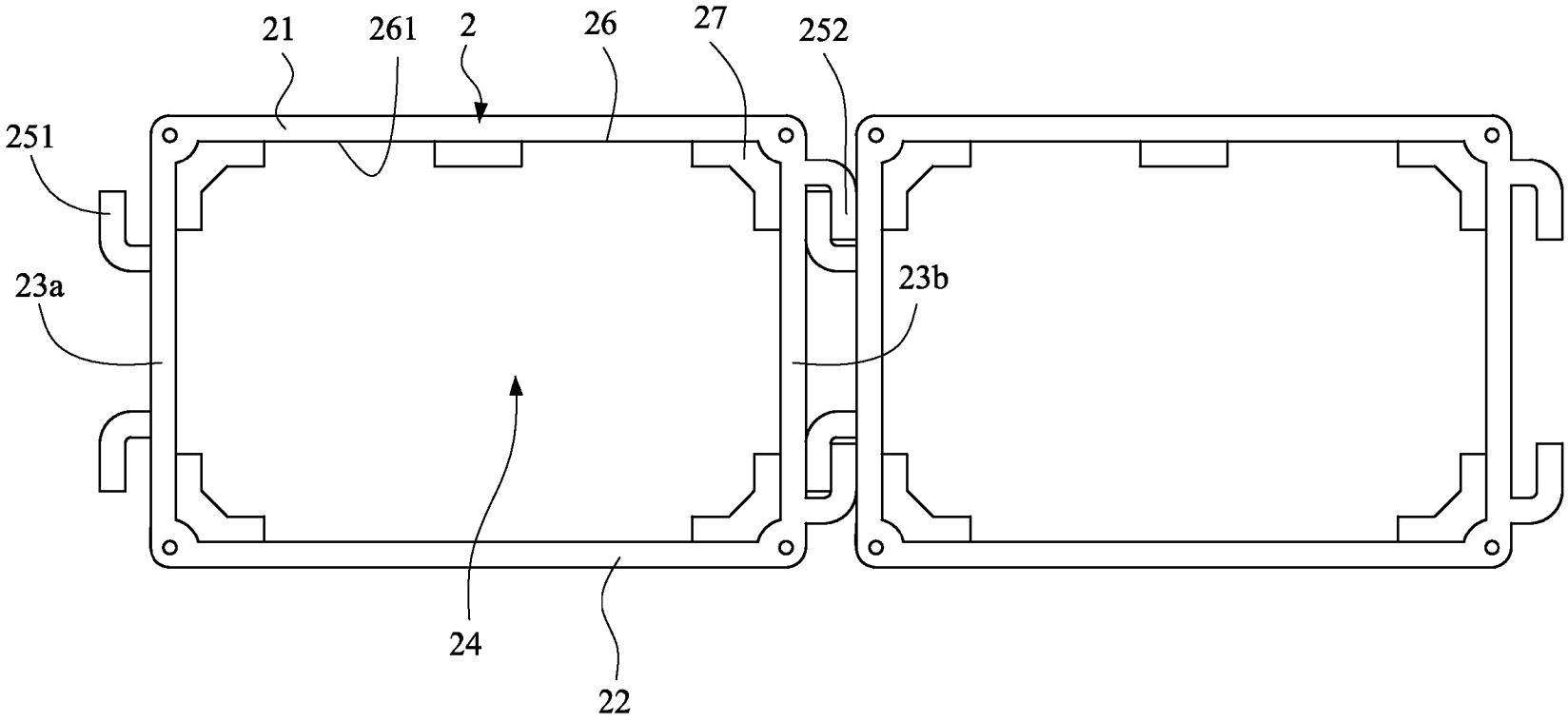
FIG. 4 is a horizontal type combination drawing illustrating a plurality of lamp socket means of an embodiment according to the present invention.
Figure 5:
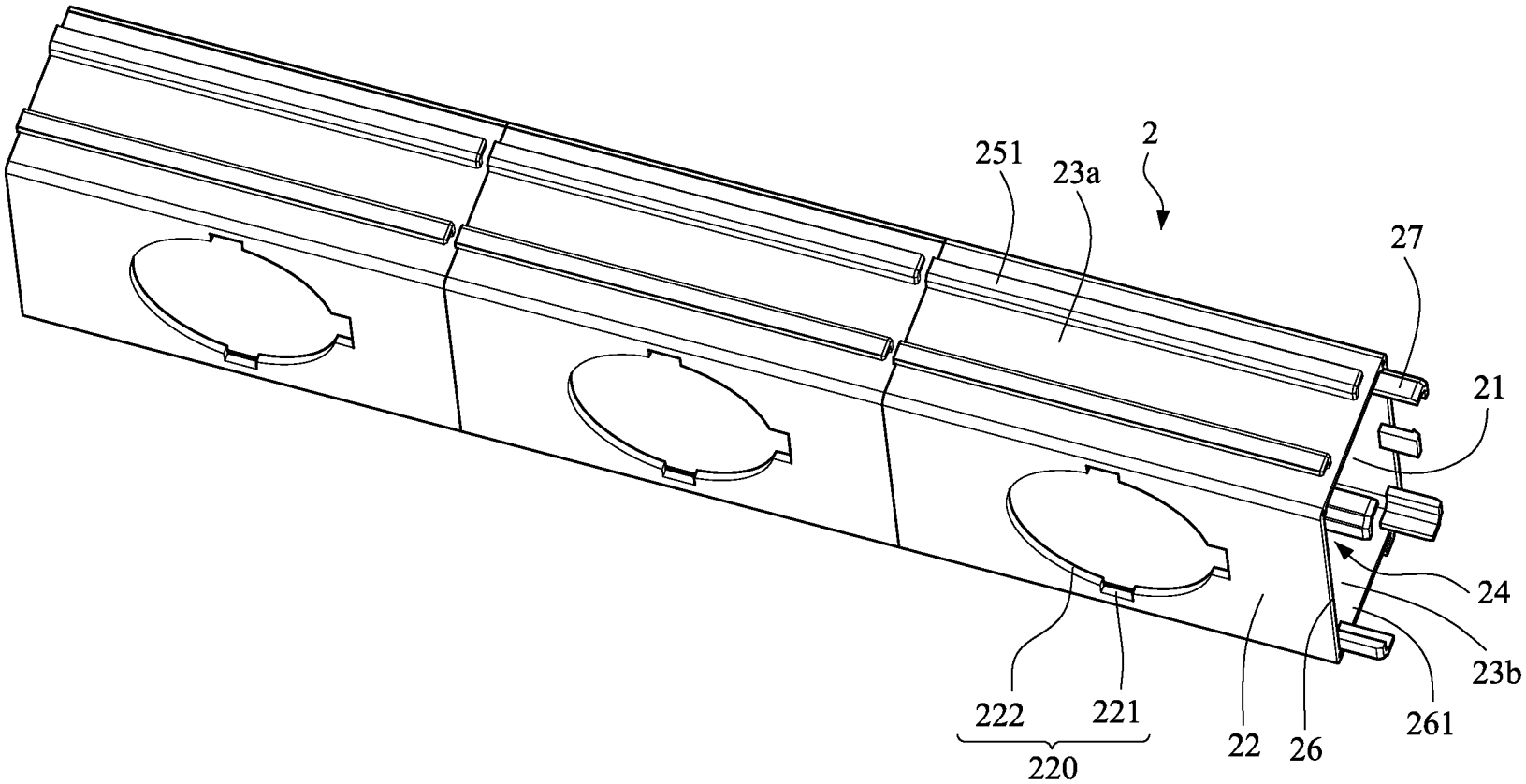
FIG. 5 is a vertical type combination drawing illustrating a plurality of lamp socket means of an embodiment according to the present invention.
Figure 6:
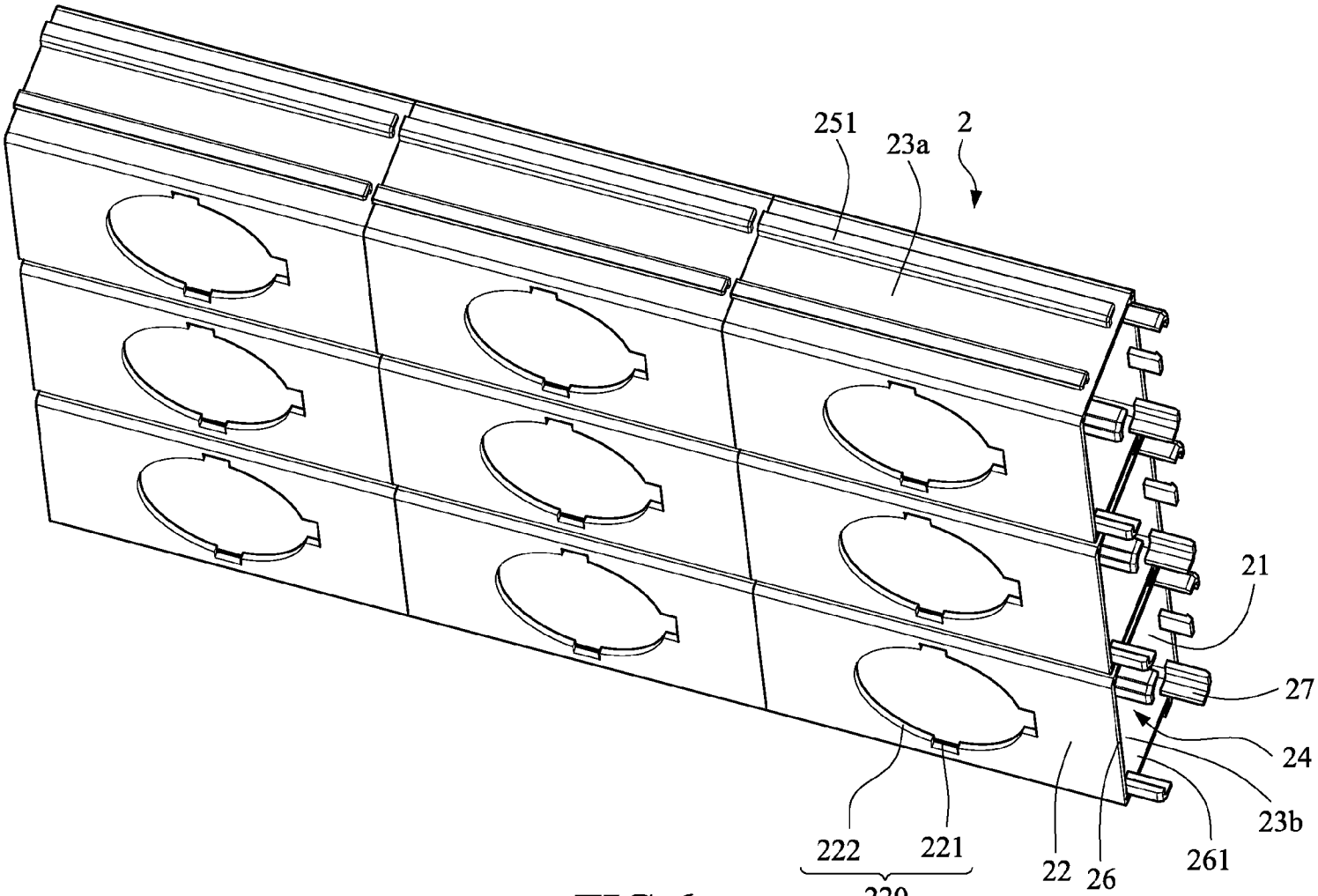
FIG. 6 is a planar type combination drawing illustrating a plurality of lamp socket means of an embodiment according to the present invention.

Selectively, the side plate 23*a* of the lamp socket means 2 is provided with a slide fastening member 251, and the side plate 23*b* is provided with a slide fastening holder 252. The slide fastening member 251 is formed as a pair of L-shaped sliding rails respectively formed bending outwardly, and the slide fastening holder 252 is formed as a pair of L-shaped slip sheet respectively formed bending inwardly. However, the present invention is not limited to this. In another embodiment, the slide fastening member 251 can be a sliding slot, and the slide fastening holder 252 can be a sliding block. Similarly, the lamp socket means 2 can be combined with another lamp socket means 2. As shown in FIG. 4 the slide fastening member 251 is provided to fasten with a slide fastening holder 252 of another lamp socket means 2 by way of slidingly forming a horizontal type of connection. Moreover, the lamp socket means 2 has two opening portions 26 communicated with the installing space 24 for the passage of wires therethrough. Selectively, a fitting element 27 convexly extends from an internal surface 261 of the opening portion 26. As shown in FIG. 5, the fitting element 27 is provided for jointing the opening portion 26 of another lamp socket means 2 to form a vertical type of connection. As shown in FIG. 6, the lamp socket means 2 can be further connected to form a planar type of connection.

As can be appreciated from the above embodiments, the switch unit of the present invention has industry worth which meets the requirement for a patent. The above description should be considered as only the discussion of the preferred embodiments of the present invention. However, a person skilled in the art may make various modifications to the present invention. Those modifications still fall within the spirit and scope defined by the appended claims.

What is claimed is:

1. An assembling heat dissipating lighting device, comprising:

a lamp socket means including an installing space and an installing hole communicated with the installing space, a periphery of the installing hole being formed with an inserting portion and an engaging portion; and a heat dissipating lighting means including a LED lighting member and a heat dissipating member thermally connected with the LED lighting member, the LED lighting member having a light emitting surface, and an outer ring surface of the LED lighting member having an engaging element corresponding to the inserting portion, and a fastening portion being formed between the engaging element and the light emitting surface, wherein the heat dissipating lighting means is fixed to the lamp socket means by disposing the heat dissipating member through the inserting portion into the installing space of the lamp socket means by way of engaging the engaging element into the installing space and correspondingly engaging the fastening portion with the engaging portion by way of rotating the heat dissipating lighting means.

2. The assembling heat dissipating lighting device as claimed in claim 1, wherein the outer ring surface of the heat dissipating lighting means is further provided with a convex ring member, and the engaging portion is formed between the convex ring member and the engaging element.

3. The assembling heat dissipating lighting device as claimed in claim 1, wherein the engaging element, at an end adjacent to the fastening portion, has a fringe selecting from one of a group of fringe consisting of a sector engaging fringe, a rectangle engaging fringe, a serrated engaging fringe, a concave arcuate engaging fringe, and a convex engaging fringe.

4. The assembling heat dissipating lighting device as claimed in claim 1, wherein the lamp socket means has a heat dissipating through hole being located in a side opposite to the installing hole and being communicated with the installing space, and the location of the heat dissipating member is facing to the heat dissipating through hole.

5. The assembling heat dissipating lighting device as claimed in claim 1, wherein the lamp socket means is provided with a slide fastening member on a side plate that is adjacent to and substantially perpendicular to a plate provided with the installing hole, and the slide fastening member is provided to fasten with a slide fastening holder of another lamp socket means by a movement of sliding.

6. The assembling heat dissipating lighting device as claimed in claim 1, wherein one side plate of the lamp socket means which is adjacent to and substantially perpendicular to a plate provided with the installing hole is provided with a slide fastening member, and another side plate of the lamp socket means is provided with a slide fastening holder.

7. The assembling heat dissipating lighting device as claimed in claim 6, wherein the slide fastening member is formed as a pair of L-shaped sliding rails respectively formed bending outwardly, and the slide fastening holder is formed as a pair of L-shaped slip sheet respectively formed bending inwardly.

8. The assembling heat dissipating lighting device as claimed in claim 1, wherein the lamp socket means has an opening portion, a fitting element convexly extends from an internal surface of the opening portion for jointing the opening portion of another lamp socket means.

9. The assembling heat dissipating lighting device as claimed in claim 1, wherein the LED lighting member includes a circular tank and a LED lighting element, the engaging element and the fastening portion are located on the outer ring surface of the circular tank, the LED lighting element has the light emitting surface, a center of a circular area of the circular tank has a light hole, and the light emitting surface is corresponding to the light hole.

10. The assembling heat dissipating lighting device as claimed in claim 1, wherein the inserting portion is an inserting groove, and the engaging element is an engaging bump.

* * * * *